US011506386B2

(12) United States Patent
Resvanis

(10) Patent No.: US 11,506,386 B2
(45) Date of Patent: Nov. 22, 2022

(54) CONDUIT

(71) Applicant: ROLLS-ROYCE plc, London (GB)

(72) Inventor: Kyriakoulis L Resvanis, Derby (GB)

(73) Assignee: ROLLS-ROYCE plc, London (GB)

( * ) Notice: Subject to any disclaimer, the term of this patent is extended or adjusted under 35 U.S.C. 154(b) by 180 days.

(21) Appl. No.: 16/262,556

(22) Filed: Jan. 30, 2019

(65) Prior Publication Data

US 2019/0264922 A1 Aug. 29, 2019

(30) Foreign Application Priority Data

Feb. 23, 2018 (GR) ..... 20180100080

(51) Int. Cl.
*F23R 3/28* (2006.01)
*F23R 3/30* (2006.01)

(52) U.S. Cl.
CPC ..... *F23R 3/286* (2013.01); *F23R 3/30* (2013.01); *F23D 2206/10* (2013.01); *F23D 2900/11101* (2013.01)

(58) Field of Classification Search
CPC ... F23D 2900/0003; F23D 2900/11101; F23D 11/101; F23D 11/102; F23D 11/103;
(Continued)

(56) References Cited

U.S. PATENT DOCUMENTS 4,260,367 A * 4/1981 Markowski ..... F23R 3/346 431/158
4,929,088 A 5/1990 Smith
(Continued)

FOREIGN PATENT DOCUMENTS

DE 4415916 A1 * 11/1995 ..... F23R 3/20
DE 4415916 A1 11/1995
(Continued)

OTHER PUBLICATIONS

Oct. 9, 2018 Search Report issued in British Patent Application GB 1806020.2.
(Continued)

*Primary Examiner* — Todd E Manahan
*Assistant Examiner* — Sean V Meiller
(74) *Attorney, Agent, or Firm* — Oliff PLC

(57) ABSTRACT

A conduit for transport of a fluid, the conduit comprising: a wall extending around and along an axis extending parallel to a direction of bulk fluid flow. The wall having an inner surface defining an interior of a channel through which fluid flows; and a plurality of projections extending from the inner surface of the wall. The plurality of projections extend around the axis, in a plane perpendicular to the axis; and wherein the projections have a height perpendicular to the axis into the channel, and the height is arranged such that the projections modify the flow of fluid at a boundary layer of the fluid adjacent the wall. The conduit is arranged to carry a first fluid; the conduit includes an opening for introducing a second fluid into the channel such that the first and second fluid are mixed downstream of the opening and the plurality of projections are provided upstream of the opening, in a direction of fluid flow.

11 Claims, 5 Drawing Sheets

(58) Field of Classification Search
CPC .... F23D 11/104; F23D 11/105; F23D 11/106; F23D 11/107; F23D 11/14; F23D 11/383; F23D 11/408; F15D 1/003; F15D 1/0035; F15D 1/005; F15D 1/06; F15D 1/065; F15D 1/012; F23R 3/12; F23R 3/14; F23R 3/286; F23R 3/30
See application file for complete search history.

(56) References Cited

U.S. PATENT DOCUMENTS

| | | | | |
|---|---|---|---|---|
| 5,274,995 | A * | 1/1994 | Horner | F23R 3/28 60/737 |
| 5,593,302 | A * | 1/1997 | Althaus | F23M 9/00 431/350 |
| 5,797,414 | A * | 8/1998 | Sirovich | B64C 21/10 137/833 |
| 6,018,963 | A | 2/2000 | Itoh et al. | |
| 6,152,724 | A * | 11/2000 | Becker | F23C 7/004 239/402 |
| 6,431,498 | B1 | 8/2002 | Watts et al. | |
| 7,266,945 | B2 | 9/2007 | Sanders | |
| 7,498,009 | B2 * | 3/2009 | Leach | B01D 53/007 204/157.3 |
| 9,109,466 | B2 * | 8/2015 | Lo | F01D 25/30 |
| 9,255,507 | B2 * | 2/2016 | Forwerck | F01N 3/2066 |
| 2003/0150932 | A1 | 8/2003 | Eberspach et al. | |
| 2005/0097889 | A1 * | 5/2005 | Pilatis | F23D 11/107 60/743 |
| 2008/0104961 | A1 * | 5/2008 | Bunker | F23D 14/62 60/737 |
| 2009/0074578 | A1 | 3/2009 | Dewar et al. | |
| 2009/0158799 | A1 | 6/2009 | Takeishi et al. | |
| 2012/0247110 | A1 | 10/2012 | Clemen | |
| 2013/0020413 | A1 | 1/2013 | Jones et al. | |
| 2013/0219895 | A1 | 8/2013 | Joshi et al. | |
| 2013/0255261 | A1 | 10/2013 | Abdelnabi et al. | |
| 2015/0115751 | A1 | 4/2015 | Horii et al. | |
| 2017/0009991 | A1 | 1/2017 | Carrotte et al. | |
| 2017/0108224 | A1 * | 4/2017 | Beck | F23R 3/36 |
| 2017/0184309 | A1 * | 6/2017 | Turrini | F23R 3/286 |

FOREIGN PATENT DOCUMENTS

| | | | | |
|---|---|---|---|---|
| EP | 1279897 | A2 | 1/2003 | |
| EP | 1391653 | A2 | 2/2004 | |
| EP | 1279897 | B1 | 1/2014 | |
| EP | 3187784 | A1 | 7/2017 | |
| GB | 881570 | A | 11/1961 | |
| GB | 2375601 | A | 11/2002 | |
| JP | H06-201512 | A | 7/1994 | |
| JP | H09-113169 | A | 5/1997 | |
| JP | 2002-286191 | A | 10/2002 | |
| WO | 99/13230 | A1 | 3/1999 | |
| WO | WO-2015049647 | A1 * | 4/2015 | B03C 3/366 |
| WO | 2017/207090 | A1 | 12/2017 | |

OTHER PUBLICATIONS

Jul. 11, 2019 extended Search Report issued in European Patent Application No. 19153464.3.
Oct. 30, 2020 Office Action issued in European Patent Application No. 19 153 464.3.
Oct. 26, 2021 Communication Under Rule 71(3) issued in European Patent Application 19 153 464.3.

* cited by examiner

CONDUIT

The present disclosure concerns a conduit for carrying a fluid, an injector for a gas turbine engine, and use of projections in a fuel or air passage of a gas turbine engine.

Gas turbine engines have fuel injectors for mixing fuel and air, and providing the mixture to a combustion chamber for combustion. The injectors include a number of conduits (passages) for carrying air, fuel or the mixture. Bends, constrictions, area with expanding cross sectional areas and other features in the conduit can cause pressure gradients, uneven flow or flow separation (i.e. the reversal of the direction of flow in the boundary layer) may also occur where fluid flowing near the boundary walls of the conduit separates from fluid flowing in the centre of the conduit. Circumferentially non-uniform or separated flows can provide undesired effects in the fluid flow, affecting the efficiency of the engine.

Honeycomb or wire mesh gratings can be used to provide even flow, and reduce separation, but these do not address effects near the wall of the conduit. In nature, tubercles are formed on the leading edge of the flipper of humpback whales. These have been shown to delay fluid separation of fluid passing over the flippers. Tubercles have also been shown to delay fluid separation in fluids passing over aerofoils.

According to a first aspect there is provided a conduit for transport of a fluid, the conduit comprising: a wall extending around and along an axis extending parallel to a direction of bulk fluid flow, the wall having an inner surface defining an interior of a channel through which fluid flows; and a plurality of projections extending from the inner surface of the wall, wherein the plurality of projections extend around the axis, in a plane perpendicular to the axis; and wherein the projections have a height perpendicular to the axis into the channel, and the height is arranged such that the projections modify the flow of fluid at a boundary layer of the fluid, adjacent the wall, the conduit is arranged to carry a first fluid, the conduit includes an opening for introducing a second fluid into the channel, such that the first and second fluid are mixed downstream of the opening, the plurality of projections are provided upstream of the opening, in a direction of fluid flow.

The projections affect the boundary layer of the fluid passing through the channel, resulting in a more circumferentially uniform flow. In regions of adverse pressure gradients (where static pressure increases in the direction of flow) the projections also extend the point at which separation of the boundary layer occurs, along the direction of the fluid flow. A region of an adverse pressure gradient may be a region of the channel in which the cross-sectional area of the channel is increasing or the region of the channel is expanding in channel size.

The height may be arranged to not affect the bulk body of the flow.

The channel may have a first dimension defined in a direction perpendicular to the axis.

The height of the projections may be less than one eighth of the first dimension. The height of the projections may be less than one tenth of the first dimension.

The height may be at least a hundredth of the first dimension. The height may be at least a fiftieth of the first dimension. The height may be at least a twentieth of the first dimension.

The height may be smaller than the integral scale for the flow in the conduit, and larger than the Kolmogorov scale for the flow in the conduit.

The plurality of projections may be provided in a region of an adverse pressure gradient in the fluid flow. A region of an adverse pressure gradient may be a region of the channel in which the cross-sectional area of the channel is increasing or the region of the channel is expanding in channel size.

The channel may be symmetrical about the axis. The projections may form a continuous ring around the wall.

The wall may include two or more planar regions, with a vertex formed where the planar regions meet. The projections may be arranged on the planar regions, away from the vertices.

The projections may be arranged symmetrically around the axis.

The conduit may further include a second wall, extending around and along the axis, arranged concentrically with the first wall, such that the channel is annular, between the first wall and the second wall. The projections may be provided on the concentrically inner wall.

The conduit may further include a second plurality of projections, formed on the second wall. The second plurality of projections may extend around the axis, in a plane perpendicular to the axis. The second plurality of projections may have a second height into the channel. The second radial may be arranged such that the second plurality of projections modify the flow of fluid at a boundary layer adjacent the wall.

The projections comprise tubercles or protuberances. Alternatively, the projections may comprise a weir, fence or step.

The conduit may include a further plurality of projections, extending around the axis at second plane, perpendicular to the axis. The further plurality of projections may have a height into the channel. The height of the further plurality of projections may be arranged such that the further plurality of projections modify the flow of fluid at a boundary layer adjacent the wall.

The conduit may be arranged to transport aviation fuel; or compressed air; or a mixture of aviation fuel and compressed air, in a gas turbine engine.

According to a second aspect, there is provided a fuel injector for a gas turbine engine, arranged to mix aviation fuel and air from compressors of the gas turbine engine, to deliver a fuel and air mixture to a combustor of the gas turbine engine, the injector having a nozzle including a plurality of passages for carrying aviation fuel; or compressed air; or a mixture of aviation fuel and compressed air, wherein one or more of the passages comprises a conduit according to the first aspect.

The projections affect the boundary layer of the fluid passing through the channel, resulting in a more circumferentially uniform flow. In regions of large adverse pressure gradients the projections also extend the point at which separation of the boundary layer occurs, along the axial direction.

The nozzle may comprise a prefilming surface for atomising fuel in air. The plurality of projections may be provided upstream of the prefilming surface, in a direction of fluid flow through the channel.

According to a third aspect, there is provided the use of projections in a conduit carrying fuel and/or air in a gas turbine, the projections formed in a perimeter wall of the conduit and the fluid having a boundary layer near the wall, and a bulk body away from the wall, the projections generating vortices near the wall, in order to redistribute momentum between the bulk body and the boundary layer.

The projections affect the boundary layer of the fluid passing through the channel, resulting in a more circumferentially uniform flow. In regions of adverse pressure gradients the projections also extend the point at which separation of the boundary layer occurs, along the axial direction. A region of an adverse pressure gradient may be a region of the channel in which the cross-sectional area of the channel is increasing or the region of the channel is expanding in channel size.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Embodiments will now be described by way of example only, with reference to the Figures, in which.

Figure 1:
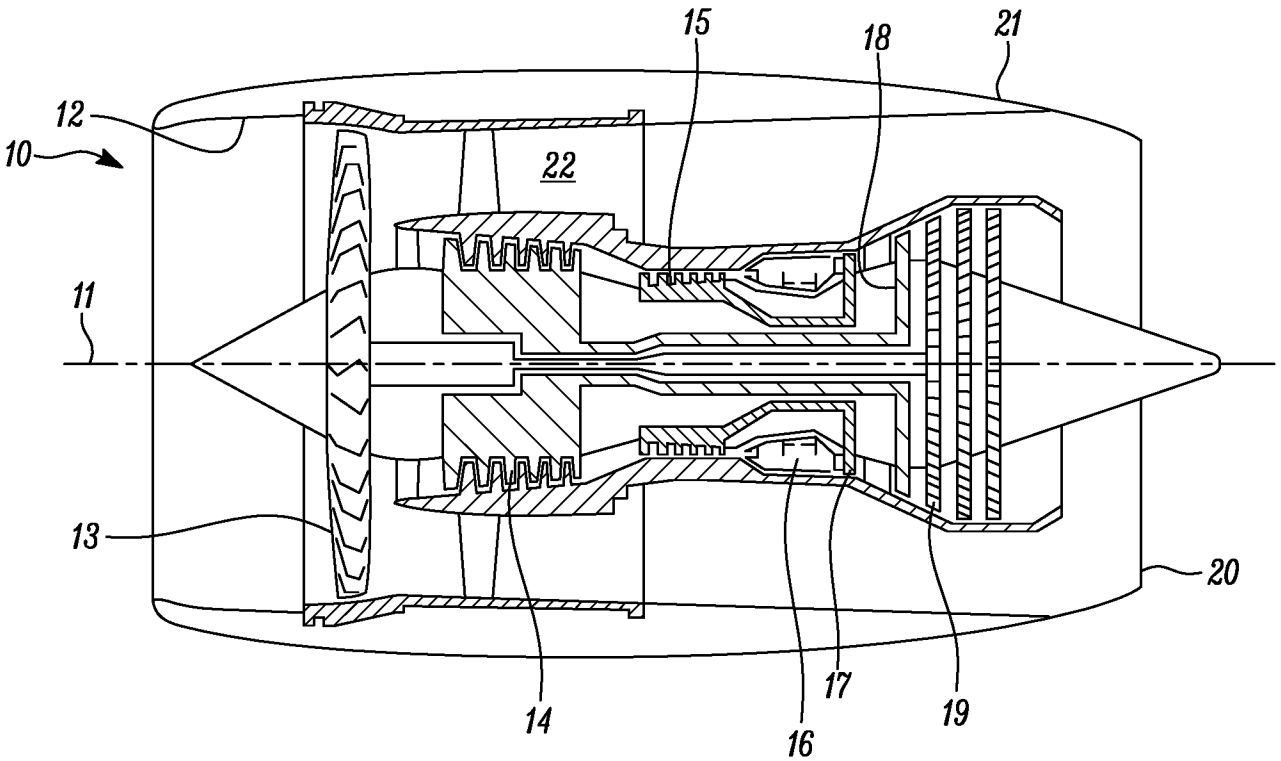
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

In a gas turbine engine 10, fuel is delivered from a reservoir or store (not shown) to the combustion equipment 16 through a fuel distribution system (not shown). The combustion equipment 16 includes a chamber (not shown) where fuel is combusted in air from the compressor stages 14, 15. Fuel and air are directed into the combustion chamber through one or more fuel injectors 30, shown in FIGS. 5A and 5B.

The fuel injector 30 includes a nozzle head 32*a,b*, for mixing fuel with air from the compressor stages 14, 15 and delivering the mixture into the combustion chamber as an atomised spray.

The nozzle head 32*a,b* extends along a central axis 34 and is annular around the axis 34. For clarity, only a portion of the annular extent of the nozzle head 32*a,b* is shown. As will be discussed in more detail below, the nozzle head 32 includes a number of conduits or passages extending along the axis 34. The conduits carry either aviation fuel, air from the compressor stages 14, 15 of the engine 10, or a fuel/air mixture. The conduits are defined by concentrically arranged cylindrical walls, and are axisymmetric about the axis 34.

A fluid flowing through a conduit, such as the ones formed in the nozzle head 32*a,b*, is formed of a boundary layer adjacent the wall, and a bulk body away from the wall. The fluid moves with different velocity in the bulk body compared to near the wall. The no-slip condition at a boundary wall means the fluid at that point to have the same velocity as the wall, usually zero. The velocity gradually increases (in a non-linear manner) away from the wall. The extent of the boundary layer is typically defined as the region required for the fluid to recover 95-99% of the free-stream velocity. In other words, the boundary layer is the region where the effects of the wall shear are noticeable.

Features in the conduit, such as bends, changes in size, or baffles or other features extending into the channel 40, can create pressure gradients and/or introduce circumferential non-uniformity into the flow. Adverse pressure gradients within the boundary layer can cause separation of the boundary layer from the bulk body of the fluid, which can be detrimental to downstream applications of the fluid. Circumferential uniformity is also desirable for optimal performance, especially in regions where the fluid stream may mix with another fluid stream (such as fuel and air).

Figure 2C:
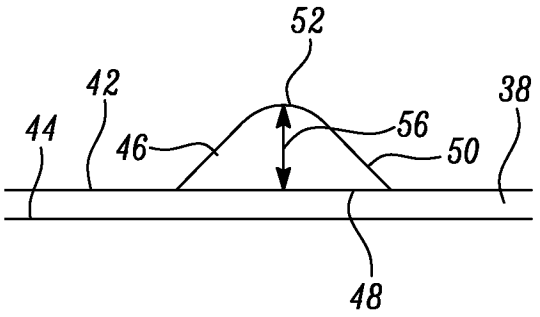
FIG. 2C shows a projection in more detail, in schematic sectional side view.
Figure 2B:
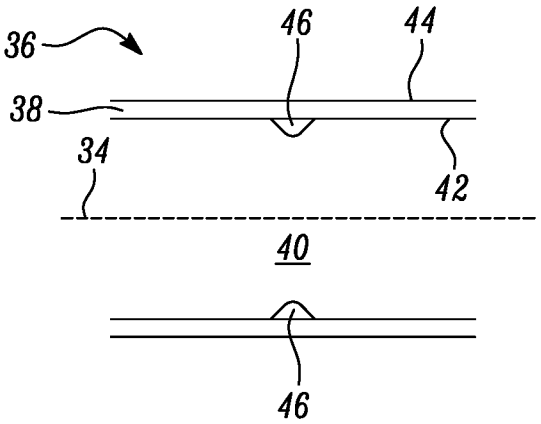
FIG. 2B is a schematic sectional side view of the conduit of FIG. 2A, with the normal of the section plane perpendicular to the principal direction of fluid flow.
Figure 2A:
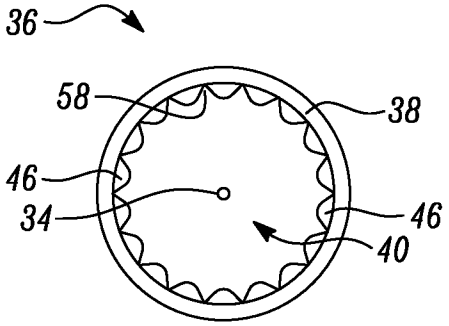
FIG. 2A is a schematic sectional end on view of a conduit according to an embodiment, with the normal of the section plane parallel to the principal direction of fluid flow.

FIGS. 2A and 2B illustrate a simplified schematic version of a conduit 36 for carrying a fluid (such as air, fuel or a fuel/air mixture) in an injector 30. FIG. 2A shows a cross section of the conduit 36 taken perpendicular to the nozzle axis 34, and FIG. 2B shows the conduit 36 taken in cross section along the nozzle axis 34.

The conduit 36 extends along the axis 34, and is formed by a cylindrical wall 38 extending around and along the axis 34. The volume within the wall 38 forms a channel 40 through which the fluid passes. The wall 38 has an inner surface 42 facing into the channel 40, and an opposing outer surface 44.

A series of rounded projections 46 (also referred to as tubercles) are formed in the inner surface 42 of the wall 38, facing into the channel 40. FIG. 2C illustrates one of the projections 46, taken in cross section along the nozzle axis 34, in more detail.

Each projection 46 has a base 48, at the inner surface 42 of the wall 38 defining the channel 40. The projection 46 is formed of a smoothly curved surface 50, extending to a tip 52. In a cross section taken across a diameter of the base 48 and through the tip 52, the curved surface is sinusoidal in shape. Each projection 46 has a height 56, extending in a radial direction with respect to the axis 34, form the base 48 (i.e. the inner surface 42 of the wall 38), to the tip 52 of the projection 46. Each projection also has a circumferential length (that is the length around the circumference of the wall 38, through the centre of the base 48), and an axial length along the axis 34 (through the centre of the base 48). In the current example, the axial and circumferential lengths of the projections are the same, and both are approximately twice the height 56.

The projections 46 are formed at the same axial position along the inner surface 42 of the wall 38, such that the projections 46 form a ring or loop, extending around the circumference of the channel 40. In other words, the projections 46 are all formed in the same plane perpendicular to the axis 34. A spacing 58 is provided between adjacent projections 46 in the band. The spacing 58 is measured around the circumference at which the tips 52 of the projections 46 is formed, and is measured as the circumferential distance between projections 46 along the inner surface 42 of the wall 38.

As fluid is flowing through the conduit 36, the projections 46 generate vortices near the wall 38. Within the generated vortices, the fluid flows around a vortex axis extending from a base to a head. The base is formed in the spacing 58 between projections 46, and the head is formed downstream, such that the vortex axis extends parallel to the bulk body flow, and the vortex is consider "stream-wise". The diameter of the vortices at their head is of similar size than the thickness of the boundary layer, and so the vortices are considered small scale with respect to the bulk body of the flow. The diameter remains constant or decreases along the length of the vortices.

The vortices redistribute momentum from more energetic parts of the fluid flow (the bulk body) to the near wall region bounded by the inner surface 42 of the wall 38. As discussed above, the velocity of the fluid increases non-linearly away from the wall 38, and so redistribution of momentum by small scale vortices has a significant effect. The added momentum close to the wall 38 ensures that the principal direction of the velocity of the boundary layer does not change, preventing flow separation. Therefore, in regions of adverse pressure gradients the set of projections 46 will prolong the point at which this separation occurs, in the axial direction.

Furthermore, even in regions without adverse pressure gradients 46 (i.e. with neutral or beneficial pressure gradients), the generation of stream-wise vortices redistributes momentum in the flow around the circumference of the channel 40, ensuring increased axisymmetric of the flow (i.e. increased uniformity).

Figure 3C:
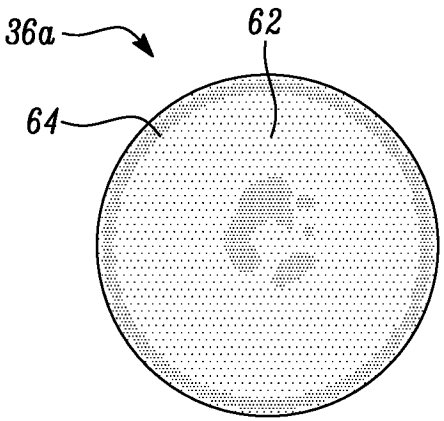
FIG. 3C illustrates the calculated turbulent kinetic energy for the conduit of FIG. 3A.
Figure 3B:
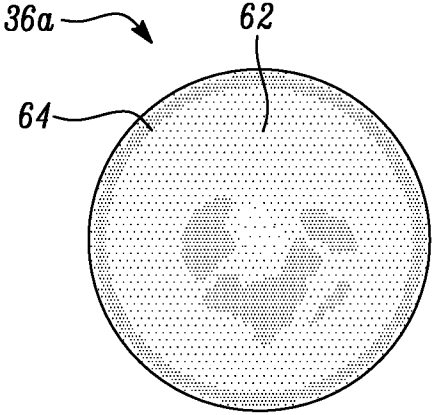
FIG. 3B illustrates the calculated turbulent kinetic energy for the conduit of FIG. 3A, without projections in the channel.
Figure 3A:
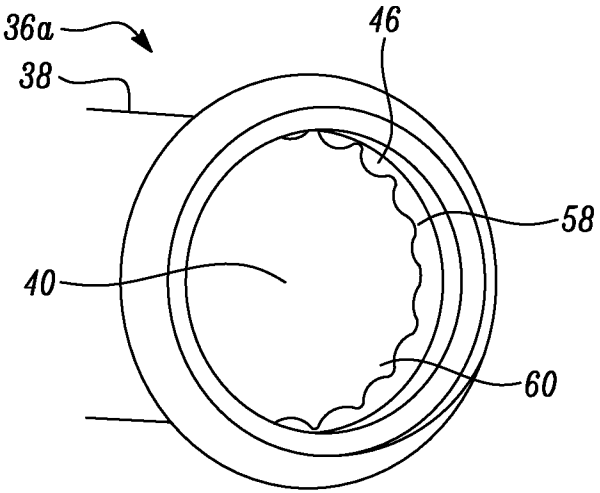
FIG. 3A is schematic perspective view of a conduit according to an embodiment.

FIG. 3A illustrates a schematic perspective view of a conduit 36*a* with a set of projections 46 formed adjacent an opening 60 of the conduit 36*a*. The projections are as described above, in relation to FIGS. 2A to 2C. FIG. 3B illustrates the turbulent kinetic energy of a fluid flowing through a conduit identical to the one on FIG. 3A, but without the projections 46 (i.e. with a smooth inner surface 42), shown in cross section perpendicular to the axis 34. The turbulent kinetic energy is calculated from high fidelity isothermal simulations (Large Eddy Simulations, at representative operating conditions). The lighter regions show the areas of higher turbulent kinetic energy. The edge of the circle shown in the image represents the wall 38, such that the wall is not shown in FIG. 3B.

As can be seen from FIG. 3B, a boundary layer 64 is formed adjacent the wall 38, and a central part of the flow forms a body 62 of the flow. The boundary layer 64 is shown by the area of high turbulent kinetic energy along the circumference of the channel 40. The formation of boundary layer may result in flow separation, at some point along the length of the channel 40. A further area of high turbulent kinetic energy is also formed within the body 62, however this is due to the presence of a centrally located swirler upstream of the section. As can be seen from FIG. 3B, this area of turbulent kinetic energy is asymmetric with respect to the axis 34.

FIG. 3C illustrates the same simulation, but including the effect of the projections 46. By comparison of FIGS. 3B and 3C, it can be seen that the boundary layer thickness 64 is narrowed, and that the flow is also more uniform near the wall 38 in the circumferential direction (i.e. around the axis 34).

In the examples shown to FIGS. 2A, 2B, and 3A, the conduit 36, 36*a* is a simple cylinder. However, it will be appreciated that the same effect can be achieved in other shaped conduits 36.

Figure 4C:
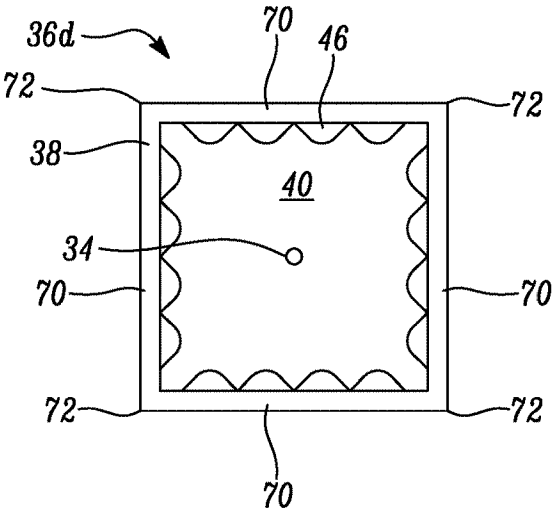
FIG. 4C illustrates a schematic sectional end on view of a third alternative conduit.
Figure 4B:
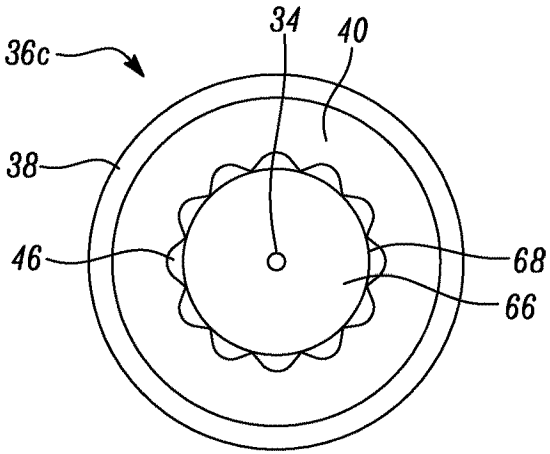
FIG. 4B illustrates a schematic sectional end on view of a second alternative conduit.
Figure 4A:
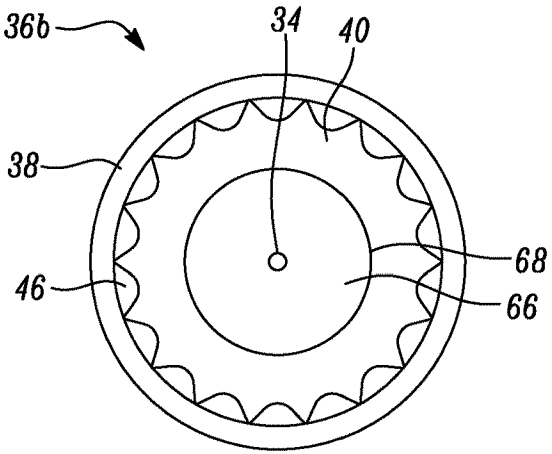
FIG. 4A illustrates a schematic sectional end on view of a first alternative conduit.

FIGS. 4A to 4C illustrate three examples of alternative conduits 36*b-d* having projections 46 arranged on an internal surface 42 of the channel. FIGS. 4A to 4C illustrate the conduits 36*b-d* in cross section perpendicular to the axis 34.

FIGS. 4A and 4B illustrate annular conduits 36*b,c*. An annular conduit 36*b,c* comprises an outer wall 38, and an inner wall 66. The outer wall 38 is cylindrical, and extends around and along the axis 34. The outer wall 38 has an inner surface 42, and an opposing outer surface 44. The inner wall 66 is also cylindrical, extending around and along the axis 34. The inner wall 66 is arranged concentrically within the outer wall 38, and has an outer surface 68 facing the inner surface 42 of the outer wall 38. Thus, a channel 40 is defined in the volume between the inner wall 66 and the outer wall 38.

It will be appreciated that any suitable arrangement may be provided within the inner wall 66. For example, the inner wall 66 may be a solid cylinder. Alternatively, a further channel may be formed within the inner wall 66.

In the example shown in FIG. 4A, the projections 46 are formed on the inner surface 42 of the outer wall 38. In the example shown in FIG. 4B, the projections 46 are formed on the outer surface 68 of the inner wall 66. It will be appreciated that either configuration may be adopted, or, in a further example, projections may be provided on both walls 38, 66.

FIG. 4C shows a conduit 36*d* that has a square cross section. In this example, the wall 38 has four planar regions 70, which meet at vertices 72. A set of projections 46 is formed on each of the planar regions 70, but not at the vertices 70. The spacing of the projections 46 from the vertices 72 is such that the projections 46 do not overlap or interfere with each other. Therefore, in some examples projections 46 may be provided to the vertex 72 on a first planar side region 70, and spaced from the vertex 72 on an adjacent region.

A conduit 36 of any shape will have a characteristic dimension, or width/diameter. Any conduit 36 is defined by walls on either side of a volume. The characteristic dimension is the smallest distance between opposing sides of the wall 38, measured in a radial direction with respect to the axis 34 (although not always passing through the axis 34, such as in an annular channel 40).

Therefore, for example, the characteristic dimension of a cylindrical conduit 36 is the diameter, the characteristic dimension of a square conduit is the width or height, and the characteristic dimension of an elliptical conduit 36 is the minor axis. For an annular conduit 36, the characteristic dimension is measured between the inner wall and the outer wall, in the radial direction.

The size of the projections 46 will depend on the flow rate and pressure of the fluid passing through the conduit 36, and the characteristic dimension of the conduit 36, at the axial position that the projections 46 are provided at.

The height 56, and axial and circumferential lengths of the projections 46 should all be smaller than the integral scale of the turbulence in the system (i.e. the average spatial fluctuation expected in the flow from larger eddies). This ensures that the vortices created do not add large scale turbulence to the flow, overall.

Furthermore, the height 56, and axial and circumferential lengths of the projections 46 should also be larger than the Kolmogorov scale of the turbulence in the system (i.e. the average spatial fluctuation expected in the flow from smaller energy dissipating eddies).

The height 56, and axial and circumferential lengths of the projections 46 should also be sized within the higher wave number extent of the Taylor scale range for the turbulence in the conduit, and should be sized to fall within the range of wave numbers corresponding to the inertial-subrange and not the higher ones typical of the Kolmogorov scales.

Typically, if the height 56, or either axial or circumferential length of the projections is more than $1/8^{th}$ of the characteristic dimension of the conduit, the projections 46 will cause changes in the body of the flow. Furthermore, if the height 56, or either axial or circumferential length of the projections is less than $1/100^{th}$ of the characteristic dimension, sufficient redistribution of momentum will not be provided.

Therefore, in general, the height 56, and the axial and circumferential lengths of the projections are between $1/8^{th}$ and $1/50^{th}$ of the characteristic dimension. In some examples, the height 56, and the axial and circumferential lengths of the projections are between $1/9^{th}$ and $1/20^{th}$ of the characteristic dimension.

Figure 5B:
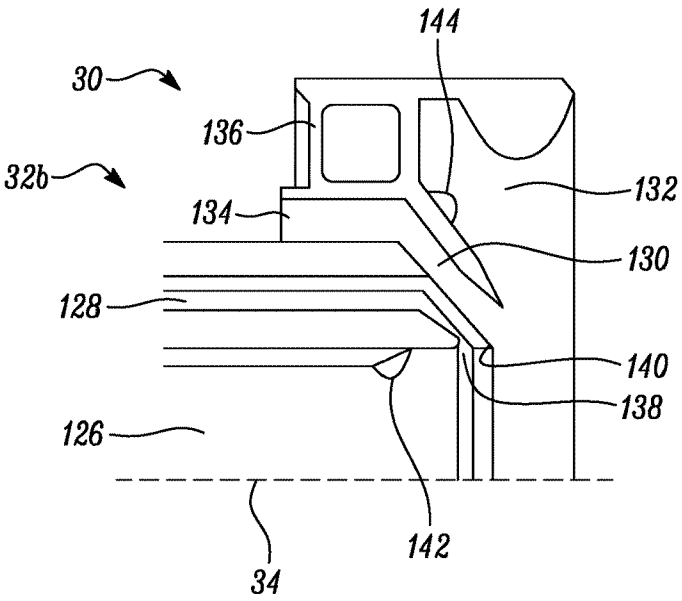
FIG. 5B illustrates a schematic sectional side view of a rich burn fuel nozzle according to an embodiment.
Figure 5A:
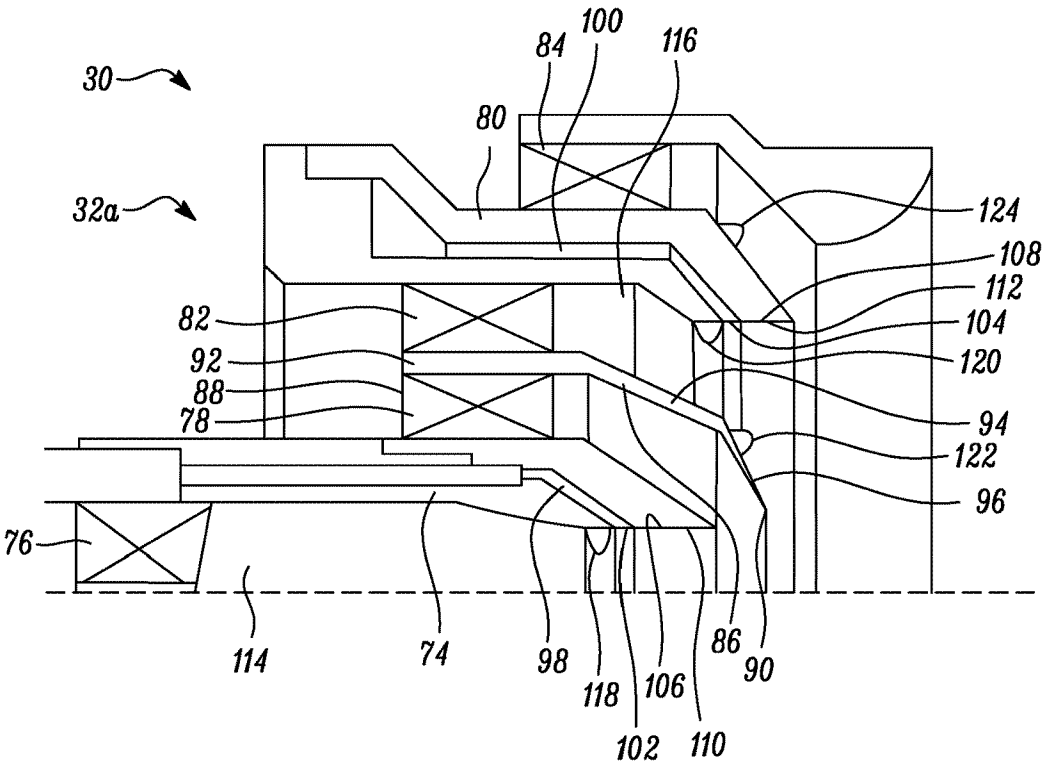
FIG. 5A illustrates a schematic sectional side view of a lean burn fuel nozzle according to an embodiment.

FIGS. 5A and 5B illustrate examples of a nozzle heads 32*a*, 32*b* including several sets of projections 46 as discussed above. The nozzle heads 32*a*, 32*b* are shown in cross section, along nozzle axis 34, and are annular and symmetric about the axis 34, although only a portion of the nozzle head 32*a*, 32*b* is shown for clarity.

FIG. 5A illustrates a nozzle head 32*a* for a lean-burn fuel injector 30, which mixes air:fuel in a ratio of 20:1 or higher.

The nozzle head 32*a* for a lean burn injector 30 includes a pilot or primary injector 74, and a main airblast fuel or secondary injector 80 arranged concentrically around the pilot injector 74. In low power operating conditions, fuel is only injected by the pilot injector 74. In higher power operating conditions, fuel is provided to the pilot injector 74 and main airblast injector 80.

A pilot inner swirler 76 is provided radially within the pilot injector 74, and a pilot outer swirler 78 is provided radially outside the pilot injector 74, and radially inside the main airblast injector 80. A main inner swirler 82 is provided concentrically within the main airblast fuel injector 80, and radially outside the pilot injector 74 and pilot outer swirler 78. A main outer swirler 84 is provided radially outside the main airblast injector 80.

Between the pilot outer swirler 78 and the main inner swirler 82, an annular splitter 86 is provided. The splitter 86 comprises an air inlet 88 at an upstream end, and an air outlet 90 at a downstream end. Extending in the downstream direction from the inlet 88, the annular splitter 86 includes a cylindrical portion 92, a first tapered portion 94, extending radially inward, and a second tapered portion 96 extending further radially inwards.

A first annularly extending passage or gallery 98 is formed within the pilot injector 74, and a second annularly extending passage or gallery 100 is formed within the main injector 80. The first annular passage 98 has a fuel opening or inlet 102 formed in an end wall 106 of the pilot injector 74. The end wall 106 extends annularly around the axis 34, and along the axis so that the fuel opening 102 faces radially inward. Similarly, the second annular passage 100 has a fuel opening or inlet 104 formed in an end wall 108 of the main airblast injector 80. The end wall 108 of the main airblast injector 80 also extends annularly around the axis 34, and along the axis so that the fuel opening 102 faces radially inward.

The section of the end walls 106, 108 axially downstream of the fuel opening 102, 104, in the direction of fluid flow (left to right on FIG. 5*a*), are fuel prefilmers having prefilming surfaces 110, 112 that the fuel flows over prior to being shed from downstream edges of the end walls 106, 108, into the swirling airflows.

At the same time as fuel is supplied via one or both of the fuel openings 102, 104, air is supplied to the prefilming surfaces 110, 112, from the high pressure compressor 14, via the pilot inner swirler 76 and inner main swirler 82 respectively. The air from the pilot inner swirler 76 passes along pilot air passage 114, past the fuel opening 102, to the prefilming surface 110. Similarly, air from the main inner swirler 82 passes along main inner air passage 116, past the fuel opening 104, to the prefilming surface 112. As such, the air passing over the prefilming surfaces 110, 112 assists with the atomisation of the liquid fuel.

A first annular ring of projections 118 is provided upstream of the pilot injector prefilming surface 110 and the pilot injector fuel opening 102, and a second annular ring of projections 120 is provide upstream of the main airblast injector prefilming surface 112 and the main airblast injector opening 104.

The presence of the rings of annular projections 118, 120 effects the boundary layer of the gas stream supplied through the air passages 114, 116 resulting in a uniform boundary layer 64 upstream of a prefilming surfaces 110, 112 and fuel openings 102, 104 and prefilming surfaces 110, 112. The uniformity of the boundary layer along the prefilming surfaces 110, 112 assists with the uniform atomization of the liquid fuel.

Adverse pressure gradients may be formed due to an expanding channel size, and the resulting tendency for the swirling flow to separate at the inner surface of the annular passage it is flowing through.

Therefore, a third annular ring of projections 122 is provided on the most downstream tapered portion 96 of the splitter 86, where the cross-section area of the main inner air passage 116 is increasing. The third annular ring of projections 122 is provided in the main inner air passage 116 on the inner surface of the main inner air passage 116, e.g. on a radially outer surface of the downstream tapered portion 96 of the splitter 86. Similarly, a fourth annular ring of projections 124 is provided in the main outer air passage after the main outer swirler 84, again on the inner surface of the main outer air passage, e.g. on a radially outer surface of a downstream tapered portion of a wall defining the inner surface of the main outer air passage.

FIG. 5B illustrates a nozzle head 32*b* for a rich-burn fuel injector 30, which mixes air:fuel in a ratio of below the stoichiometric ratio, for example at 4:1.

The nozzle head 32*b* for the rich-burn fuel injector 30 comprises an airblast fuel injector. The airblast fuel injector has, concentrically from the axis 34 outward, an inner air swirler passage 126, a fuel passage 128, an intermediate air swirler passage 130 and an outer air swirler passage 132. The swirling air passing through the air swirler passages 126, 130, 132 of the nozzle head 32*b* is high pressure and high velocity air derived from the high pressure compressor 14. Each air swirler passage 126, 130, 132 has a respective swirler 134, 136 (and an inner swirler, not shown) which swirls the air flow through that passage. The fuel passing through the fuel passage 128 encounters the high velocity airstream at a fuel passage opening 138, and along the prefilming surface 140 provided downstream of the opening.

As with the lean-burn injector, a first annular ring of projections 142 is provided upstream of the prefilming surface 140 and the liquid passage opening 138.

The presence of the annular rings of projections 142 effects the boundary layer of the air stream supplied through the air passage 126 resulting in a uniform boundary layer 64 upstream of the prefilming surface 140 and fuel opening 138. The increase uniformity of the boundary layer along the prefilming surfaces 140 assists with the uniform atomization of the liquid fuel.

A second annular ring of projections 144 is also provided in a position of adverse pressure gradient, in the outer air passage 132, where the cross sectional area of the outer air passage 132 is increasing. The second annular ring 144 is provided on the inner wall of the outer air passage 132, again on the inner surface of the outer air passage 132, e.g. on a radially outer surface of a downstream tapered portion of an inner wall defining the inner surface of the outer air passage 132.

A fuel injector for a gas turbine engine may comprise a wall extending around and along an axis, the wall having an inner surface defining a passage through which air flows, the wall including an opening for introducing fuel into the passage, the wall having a prefilming surface for atomising fuel in air downstream of the opening; wherein the wall having a plurality of projections upstream of the prefilming surface.

The fuel injector may comprise an air passage, the air passage being defined between an inner wall extending around and along an axis and an outer wall extending around and along the axis, the cross sectional area of the air passage increasing, the inner wall of the air passage having a downstream tapered portion, the inner wall having an outer surface, the outer surface of the inner wall having a plurality of projections.

A fuel injector for a gas turbine engine may comprise an air passage, the air passage being defined between an inner wall extending around and along an axis and an outer wall extending around and along the axis, the cross sectional area of the air passage increasing, the inner wall of the air passage having a downstream tapered portion, the inner wall having an outer surface, the outer surface of the inner wall having a plurality of projections.

The projections 46 could be used in any conduit 36. The examples shown in FIGS. 2A, 2B, 3A, 4A, 4B, 5A, and 5B are just some examples of axisymmetric conduits 36, 36*a-c*, 84, 114, 116 126, 132. The conduit 36 may also be conical (i.e. with a tapering or increasing diameter), or any other axisymmetric shape. FIG. 4C is just one example of a conduit 36*d* that is not axisymmetric. In other examples, the conduit 36 may have other asymmetrical shapes about the central axis 34. For example, the conduit may be elliptical or any other shape.

The use of sinusoidal tubercles 46, as discussed above, is by way of example only. Any form of tubercle or protrusion may be used. For example, the protrusions may be of any suitable shape to achieve the same small scale stream-wise vortices that redistribute energy in the fluid flow. For example, the projections may be hemispherical, elliptical, or any other shape.

Furthermore, in alternative examples, small fences or steps in the surface 42 of the wall may be used instead of tubercles. The steps or fences may by a barrier extending circumferentially around the wall 38, having a planar surface extending either radially or inclined with respect to the radial direction. Gaps may be formed around the barrier, in a similar manner to the spacing 58 between projections discussed above. The tubercles 46, protrusions, fences, and steps are all examples of projections that may form vortices in the flow, redistributing momentum in the fluid from high velocity areas to the boundary layer.

Any suitable spacing 58 may be provided between projections 46, in the direction around the circumference of the wall 38. The spacing may be constant around the circumference, or the spacing may vary in any patterns, around the circumference. For example, there may be groups of closely spaced projections 46, separated by a larger gap, or the spacing may change around the circumference.

In the example discussed above, a single annular set of projections is formed in the conduit 36. In other cases, further sets may be provided at different positions along the length of the conduit. Each set will be as described above, although different sets may have different sizes and arrangements. The axial spacing between different sets should be chosen depending on the expected turbulence. In some instances, the set of projections 46 may be provided at an opening of the conduit 36, however, this is not always the case. The projections 46 may be formed on the inner or outer walls of the conduit.

Conduits 36 with a set of annular projections 46 may be formed by any suitable technique. In some examples, the projections are formed in situ, as the conduit wall 38 is formed. For example, the conduit 46 may be formed by casting, direct laser deposition, or additive layer manufacturing techniques.

The injectors 30 discussed above are given by way of example only. It will be appreciated that conduits with projections 46 may be formed in any type of rich burn or lean burn injector 30. Furthermore, the positions of the annular rings of tubercles 118, 120, 122, 124, 142, 144 are given by way of example only. An injector may include projections 46 in any or all of these positions, or in other suitable locations.

It will be appreciated that the example of a fuel injector 30 of a turbine engine 10 is just one possible application for the conduits discussed above. The annular projections 46 may be used in any conduit for carrying fuel or air in a gas turbine engine, or any other conduit for transporting any fluid, rather than water or air.

For example, a set of annular projections 46 may also be used in compressor pre-diffusers, where the boundary layer sometimes detaches from one of the surfaces, and the bypass duct 22.

Furthermore, the use of a conduit 36 with annular projections 46 may find application within the marine engines. For example, the projections 46 may be provided within the duct of water-jets, downstream of the intake and upstream of the impeller, since providing more uniform flow to an impeller can improve performance.

It will be understood that the invention is not limited to the embodiments above-described and various modifications and improvements can be made without departing from the concepts herein. Except where mutually exclusive, any of the features may be employed separately or in combination with any other features and the disclosure extends to and includes all combinations and sub-combinations of one or more features described herein.

The invention claimed is:

1. A fuel injector for a gas turbine engine, the fuel injector comprising; a first fluid passage, the first fluid passage being defined between an inner wall extending around and along an axis and an outer wall extending around and along the axis, wherein: the inner wall has an outer surface with a first plurality of projections, the outer wall has an inner surface with a second plurality of projections, in a cross section taken across a diameter of a base of each of the first plurality of projections and through a tip of each of the first plurality of projections, a smoothly curved surface formed by the first plurality of projections that extend continuously around the axis has a sinusoidal shape, and in a cross section taken across a diameter of a base of each of the second plurality of projections and through a tip of each of the second plurality of projections, a smoothly curved surface formed by the second plurality of projections that extends continuously around the axis has a sinusoidal shape, wherein the outer wall includes an opening for introducing fuel into the first fluid passage, the outer wall has a prefilming surface for atomizing fuel in air downstream of the opening, the second plurality of projections are upstream of the prefilming surface, an axial length and a circumferential length of each projection of the first plurality of projections and the second plurality of projections are the same, and a cross sectional area of the first fuel passage increases with the inner wall having a downstream tapered portion.

2. The fuel injector of claim 1, wherein the first fluid passage has a first dimension defined in a direction perpendicular to the axis, and wherein the height of the second plurality of projections is less than one seventh of the first dimension.

3. The fuel injector of claim 2, wherein the height of the second plurality of projections is less than one eighth of the first dimension.

4. The fuel injector of claim 2, wherein the height is at least a hundredth of the first dimension.

5. The fuel injector of claim 4, wherein the height is at least a fiftieth of the first dimension.

6. The fuel injector of claim 1, wherein the second plurality of projections are provided in a region of an adverse pressure gradient in a fluid flow in the first fluid passage.

7. The fuel injector of claim 1, wherein the second plurality of projections are arranged symmetrically around the axis.

8. The fuel injector of claim 1, wherein the second plurality of projections comprise tubercles or protuberances.

9. The fuel injector of claim 1, wherein the second plurality of projections comprise a weir, fence or step.

10. The fuel injector of claim 1, wherein the first fluid passage is arranged to transport aviation fuel; or compressed air; or a mixture of aviation fuel and compressed air, in a gas turbine engine.

11. The fuel injector for a gas turbine engine of claim 1, wherein the fuel injector is arranged to mix aviation fuel and air from compressors of the gas turbine engine, to deliver a fuel and air mixture to a combustor of the gas turbine engine, the fuel injector having a nozzle including a plurality of passages for carrying aviation fuel; or compressed air; or a mixture of aviation fuel and compressed air, wherein one or more of the passages includes the first fuel passage.

* * * * *